US008771790B2

(12) United States Patent
de Vink

(10) Patent No.: US 8,771,790 B2
(45) Date of Patent: Jul. 8, 2014

(54) METHOD OF REDUCING MAGNETITE FORMATION

(76) Inventor: Michael John de Vink, Warragul (AU)

( * ) Notice: Subject to any disclaimer, the term of this patent is extended or adjusted under 35 U.S.C. 154(b) by 0 days.

(21) Appl. No.: 13/144,422

(22) PCT Filed: Jan. 12, 2010

(86) PCT No.: PCT/AU2010/000024

§ 371 (c)(1),
(2), (4) Date: Aug. 11, 2011

(87) PCT Pub. No.: WO2010/081189

PCT Pub. Date: Jul. 22, 2010

(65) Prior Publication Data

US 2011/0293827 A1 Dec. 1, 2011

(30) Foreign Application Priority Data

Jan. 13, 2009 (AU) ..... 200900119

(51) Int. Cl.

| | |
|---|---|
| ***F28F 21/08*** | (2006.01) |
| ***B05D 7/22*** | (2006.01) |
| ***F28F 19/06*** | (2006.01) |
| ***F28F 19/02*** | (2006.01) |
| ***F28G 9/00*** | (2006.01) |
| ***C23C 18/16*** | (2006.01) |
| ***C23C 18/18*** | (2006.01) |
| ***C23C 18/31*** | (2006.01) |
| ***C23C 18/32*** | (2006.01) |
| ***C23C 18/34*** | (2006.01) |
| ***C23C 18/42*** | (2006.01) |
| ***C23C 18/44*** | (2006.01) |
| ***C23C 18/54*** | (2006.01) |

(52) U.S. Cl.

CPC ..... *F28F 19/06* (2013.01); *F28F 19/02* (2013.01); *F28F 21/08* (2013.01); *F28G 9/00* (2013.01); *C23C 18/16* (2013.01); *C23C 18/18* (2013.01); *C23C 18/31* (2013.01); *C23C 18/32* (2013.01); *C23C 18/34* (2013.01); *C23C 18/42* (2013.01); *C23C 18/44* (2013.01); *C23C 18/54* (2013.01); *B05D 7/22* (2013.01)

USPC ..... 427/239; 427/230; 427/327; 427/419.1; 427/419.2; 427/419.3; 427/437; 427/443.1; 138/145; 138/146; 165/95; 165/133; 165/180; 106/14.05

(58) Field of Classification Search
None
See application file for complete search history.

(56) References Cited

U.S. PATENT DOCUMENTS

| | | | | |
|---|---|---|---|---|
| 4,013,488 | A | 3/1977 | Ramqvist et al. | |
| 4,204,862 | A | 5/1980 | Kado et al. | |
| 4,369,073 | A * | 1/1983 | Fukutsuka et al. | 148/287 |
| 4,726,813 | A * | 2/1988 | Viscovich | 95/28 |

FOREIGN PATENT DOCUMENTS

| | | |
|---|---|---|
| AU | 199950110 | 3/2000 |
| JP | 60-052581 | 3/1985 |
| WO | WO 2007/075634 | 7/2007 |

OTHER PUBLICATIONS

Notification of Transmittal of International Preliminary Report on Patentability corresponding to International Patent Application No. PCT/AU2010/000024 dated May 25, 2010.

Australian Patent Office International-Type Search Report corresponding to Australian Application No. 2009900119 dated Mar. 13, 2009.

Shaw et al., "Corrosion-Resistant Power Metallurgy Alloys," ASM Handbook, vol. 13B, ASM International, pp. 447-475 (2005).

International Search Report and Written Opinion corresponding to International Patent Application No. PCT/AU2010/000024 dated Mar. 16, 2010.

* cited by examiner

*Primary Examiner* — William Phillip Fletcher, III
(74) *Attorney, Agent, or Firm* — Jenkins, Wilson, Taylor & Hunt, P.A.

(57) ABSTRACT

A method of reducing magnetite formation in the bore of a pipe including the steps of selecting a pipe with a pre-existing oxide layer on its inner bore surface and coating the pre-existing oxide layer with an oxidation resistant metal to thereby reduce magnetite formation in the bore of the pipe.

21 Claims, 4 Drawing Sheets

METHOD OF REDUCING MAGNETITE FORMATION

FIELD OF THE INVENTION

The present invention relates to the reduction of oxide build up in superheater and reheater tubing and, more particularly, relates to the reduction of magnetite build up and exfoliation in said tubing.

BACKGROUND OF THE INVENTION

Boilers commonly use superheaters and reheaters to achieve higher output performance and thereby increase the efficiency of their operation. Typically, superheaters and reheaters comprise metallic piping which is often formed from ferritic and/or austenitic alloy steel and, particularly, stainless steels such as SS321 and SS347, among others.

The piping in the superheaters and reheaters of boilers operate in a high temperature environment for extended periods during which a two layer oxide develops on the inner bore of the tubes which is in contact with the steam. The layers of oxide together are, in some respects, technically desirable as they serve to protect the tube material from further corrosion by forming a protective layer.

FIG. 1A shows the oxide layers formed on the inner surface of a superheater or reheater tube 10. The oxide protective layer comprises two distinct layers, an inner oxide layer consisting of a fine grained Fe—Cr spinel oxide 12 adhering directly to tube material 11, and an outer oxide layer closest to the tube bore centre in contact with the steam inside the tube consisting of columnar-grained, porous magnetite 13 (being $Fe_3O_4$ often with some content of haematite $Fe_2O_3$).

As indicated in FIG. 1B, the two oxide layers have very different coefficients of thermal expansion and, in certain tubing compositions, coupled with large temperature fluctuations, such as when a boiler is cooled down, the magnetite layer 13 will delaminate from the Fe—Cr spinel layer 12, forming flakes of exfoliated magnetite. While the magnetite and spinel layers together are desirable for their corrosion protection characteristics, exfoliation of magnetite can be extremely problematic, particularly if it occurs in pendant type superheaters and reheaters, as the exfoliated magnetite will fall and collect in the bends at the bottom of the pendant resulting in blockage of the tube. FIG. 2 is a schematic representation of a typical high temperature boiler 20 with pendant superheater and reheaters. The collection areas for exfoliated magnetite are indicated by numeral 22.

Such blockages cannot be detected by ordinary means. Pipe blockage results in impeded steam flow causing overheating of the affected area of the superheater or reheater pipe, followed by creep rupture and failure of the tube. Pipe failures in superheaters and reheaters rapidly lead to secondary damage by steam erosion to adjacent tubes and consequently further failures follow quickly, until steam leakage within the boiler reaches a level where it cannot be tolerated and the boiler must be shut down to make repairs. The costs of lost production due to a single superheater or reheater tube failure can amount to millions of dollars per occurrence.

Prior art solutions to the problem of magnetite exfoliation typically tackle the problem by one of two approaches. The first is preventative, through the selection of special tube materials for use in the superheaters and reheaters at the time of original manufacture which tend not to form thick magnetite layers and accordingly help reduce exfoliation. The second approach is reactive to the existing problem by way of proposing methods to remove magnetite from tubes once it has already formed into an exfoliable layer or has already exfoliated as magnetite flakes.

One prior art preventative solution is the use of special stainless steel compositions having fine grain structures which exhibit a reduced propensity for the formation of exfoliated magnetite, such as stainless steel 347HFG, amongst others. While the manufacturers of this material have promoted the benefit of reduced magnetite exfoliation there has been at least one technical paper published documenting the occurrence of tube blockage after magnetite exfoliation from a superheater fabricated from this material.

Another prior art preventative solution is the use of a shot peening treatment for tubing during manufacture which modifies the grain structure of the tube material on the inner bore, as above, supposedly achieving a reduced propensity for the formation of exfoliated magnetite during operation.

Each of the above mentioned approaches employing a preventative solution generally results in at least a degree of reduction of magnetite exfoliation if implemented prior to fabrication of the boiler superheaters and reheaters. However, for the many existing superheaters and reheaters constructed from tube materials not preselected for the avoidance of magnetite exfoliation, none of the above techniques can be applied in situ, nor conveniently or economically retro-fitted.

Prior art solutions which are reactive in nature respond to the occurrence of magnetite exfoliation by the employment of methods to effect the deliberate physical removal of the exfoliated magnetite flakes. One such prior art solution is that disclosed in Australian Patent No 748326, in the name of C S Energy Limited, which describes a system for the removal of exfoliated magnetite during plant shutdown by fluidizing the exfoliated flakes in a carrier gas through the sudden controlled rapid depressurization of the boiler steam circuits, after charging to high pressure with a gas, thus conveying the flakes through the circuits to a desirable venting point for expulsion from the boiler.

Another reactive prior art solution is the cleaning of the superheater or reheater tubes using chemicals, including acids, which will dissolve the exfoliated magnetite flakes, as well as the delaminated but adherent magnetite layer. These can then be flushed from the boiler circuits thus removing the danger of exfoliated and loose magnetite. While chemical cleaning of this kind may be effective to remove magnetite it cannot be performed economically on a regular basis. A further consideration is that the plant's operational life is reduced by repeated removal and re-oxidation of tube material, leading to eventual thinning of the tube walls to the point where replacement is necessary. A further undesirable result of frequent chemical cleaning is the resultant large volumes of liquid waste containing dissolved metals, including chromium, which are difficult and/or expensive to dispose of in an environmentally satisfactory way.

Accordingly, it is desirable to provide an improved method for reducing the build up and/or subsequent exfoliation of magnetite in existing superheater and reheater tubes. This will result in a significantly reduced requirement for plant downtime for removal of exfoliated magnetite.

OBJECT OF THE INVENTION

The object of the invention is to overcome or at least alleviate one or more of the above problems and to provide for a process which results in a reduction in the amount of, or slowing down of the build up of, exfoliable magnetite inside tubing exposed to high temperatures, or which reduces the exfoliation of said magnetite.

SUMMARY OF THE INVENTION

In one broad form, although it need not be the only or indeed the broadest form, the invention resides in a method of reducing magnetite formation in the bore of a pipe by plating the inner surface of the pipe with an oxidation resistant metal.

Typically the pipe is a superheater and/or reheater pipe. In a first aspect the invention resides in a method of reducing magnetite formation in the bore of a pipe including the steps of:

(a) selecting a pipe with a pre-existing oxide layer on its inner bore surface; and (b) coating the pre-existing oxide layer with an oxidation resistant metal, to thereby reduce magnetite formation in the bore of the pipe.

Preferably, the pipe is manufactured from an austenitic and/or ferritic alloy.

Typically the pipe is a superheater and/or reheater pipe.

Suitably, the pre-existing oxide layer is an Fe—Cr spinel oxide layer. If required, the coating step is carried out by electroless plating of the oxidation resistant metal.

Preferably, the oxidation resistant metal is oxidation and corrosion resistant at high temperatures.

More preferably, the oxidation resistant metal is selected from the group consisting of nickel, palladium and alloys thereof. Even more preferably, the oxidation resistant metal is nickel or a nickel alloy.

Preferably, the oxidation resistant metal forms a layer between 5 μm to 200 μm thick. More preferably, the layer of oxidation resistant metal is between 10 μm to 100 μm thick.

In a second aspect the invention resides in an apparatus for reducing magnetite formation in the bore of a pipe comprising:

(a) a solution to substantially remove existing magnetite from the bore of the pipe and expose an underlying Fe—Cr spinel oxide layer;

(b) an electroless plating solution to coat the Fe—Cr spinel oxide layer with a layer of oxidation resistant metal; and (c) a system for the delivery, circulation and removal of the magnetite removal solution and electroless plating solution.

Further features of the present invention will become apparent from the following detailed description. The terms 'pipe' and 'tube' and 'piping' and 'tubing' are used interchangeably in this specification. Although in certain instances in the power industry these terms may be used to differentiate between hollow metal bodies of different dimensions or those in specific locations the terms are used in a broader sense within this document. Generally, these terms are used to refer to any hollow length of a superheater and/or reheater and associated framework in which magnetite may form.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE FIGURES

In order that the invention may be readily understood and put into practical effect, preferred embodiments will now be described by way of example with reference to the accompanying figures wherein.

Figure 1A:
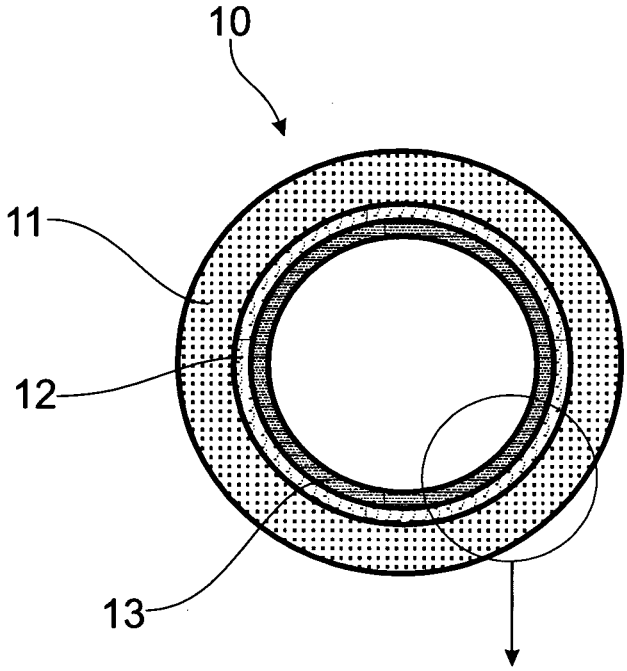
FIG. 1A is a sectional representation of a typical superheater or reheater pipe showing the oxide layers formed on the tube inner surface.

Any notations on the drawings are by way of illustration or example only and are not limiting to the present invention.

DETAILED DESCRIPTION OF THE INVENTION

The present inventor has developed a method for reducing magnetite formation, and hence exfoliation, in the bore of superheater and reheater pipes. The method is particularly suitable for, but not limited to, the treatment of austenitic and/or ferritic alloy steel superheater and reheater pipes which have been in operation for a sufficient period of time for a layer of Fe—Cr spinel oxide to have formed on the pipes inner surface.

The term 'spinel oxide' or 'spinel' are interchangeable and are used herein to refer to a class of minerals which share a crystal arrangement or packing of their component elements and which generally have the standard formula $A(B)_2O_4$. The A and B usually represent different metal ions that occupy specific sites within the crystal structure. An example of one such spinel oxide is 'chromite' which is an 'Fe—Cr spinel oxide with the formula $FeCr_2O_4$. Although Fe—Cr spinel oxides are the preferred spinel oxides of the present invention, other spinel oxides comprising, for example, magnesium, manganese, nickel, aluminium, titanium, and combinations thereof, are also considered to be within the scope of the present invention.

The term Fe—Cr spinel oxide as used herein refers to a spinel oxide layer which substantially comprises an oxide compound or a number of different oxide compounds of iron and chromium. In the art it is widely understood that the term Fe—Cr spinel oxide will refer to a layer which actually comprises a large range of different iron and chromium oxide compounds which all have a spinel shaped crystalline structure. These different oxides tend to exist in an amorphous mix with varying ratios from layer to layer and so, rather than attempting to define all compounds present in the layer the term Fe—Cr spinel oxide is used as a generic or blanket term by metallurgists and the like. Non-limiting examples of such Fe—Cr spinel oxides include chromite ($FeCr_2O_4$) and $Fe_2CrO_4$. Fe—Cr spinel oxide layers may also comprise other spinel compounds which contain either iron or chromium (but not both) or which contain neither iron nor chromium. These alternative spinel oxides will, however, not form the majority of the Fe—Cr spinel oxide layer.

In one embodiment, the method involves coating a layer of an oxidation resistant metal, for example nickel, palladium and/or an alloy thereof, onto a spinel oxide layer present on the inner bore of a superheater and/or reheater pipe by electroless plating. This newly formed layer of oxidation resistant metal will substantially reduce the build up, and hence exfoliation, of magnetite and will thereby reduce the amount of operational downtime normally required for regular removal of built up and exfoliated magnetite. An Fe—Cr spinel oxide represents a preferred spinel oxide providing an optimal stratum for adhesion of the protective oxidation resistant metal layer.

Figure 1B:
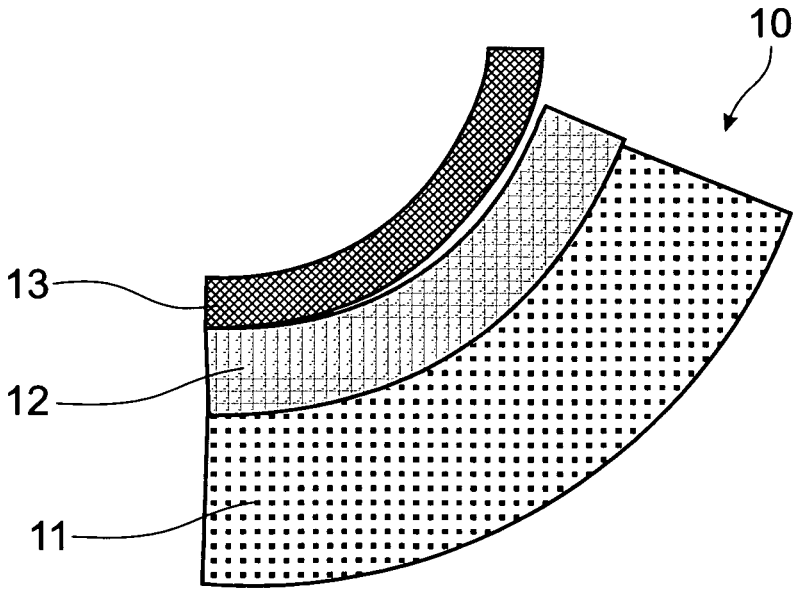
FIG. 1B is an enlarged view of the circled area shown in FIG. 1A.

FIGS. 1A and 1B are sectional representations of an existing superheater or reheater pipe 10 showing the oxide layers formed on the pipe inner surface. The pipe has been in operation for a sufficient period of time for a layer of Fe—Cr spinel oxide 12 to form directly onto the inner surface of the pipe or tube 11. A layer of magnetite 13 has then formed on top of the Fe—Cr spinel oxide 12 and has built up to such an extent that it is delaminating from that layer, as can be seen in FIG. 1B. The layer of magnetite 13, or flakes thereof, will eventually exfoliate and can get stuck in pipe 10 to cause blockages, as shown in FIG. 2.

Figure 2:
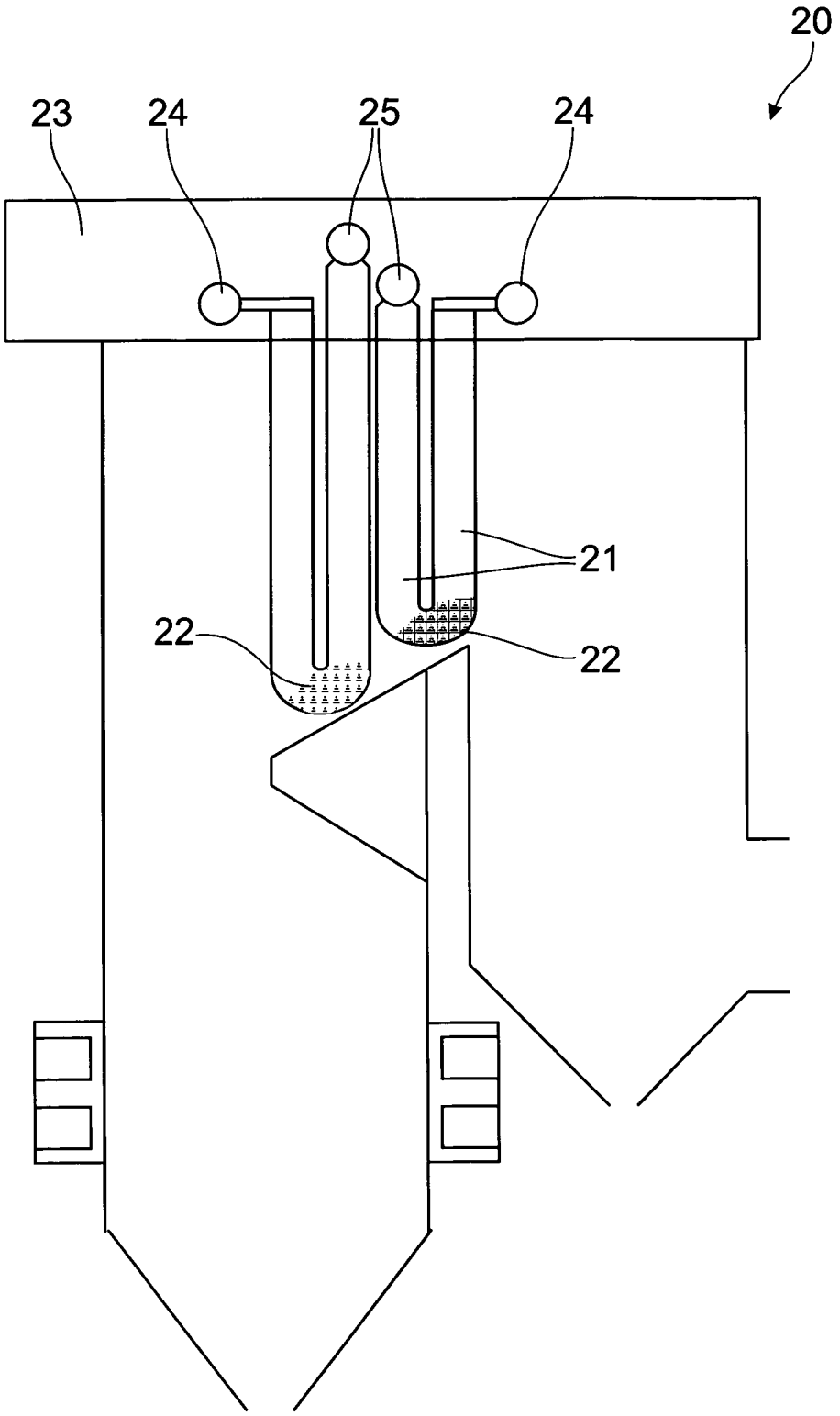
FIG. 2 is a schematic side view representation of a typical high temperature boiler with pendant superheater and reheaters.

FIG. 2 is a schematic side view representation of a typical high temperature boiler 20 with pendant superheater and reheaters. The vestibule or header space 23 of the boiler is shown containing the superheater and/or reheater inlet headers 24 and outlet headers 25. The pipes 21 of the superheater and/or reheater are seen to be pendant and exfoliated magnetite 22 has collected in the bends of the pipes and is lodged there. This blockage impedes steam flow and can cause localised overheating and rupture of the pipe, as mentioned previously. It is, therefore, critical that magnetite formation and exfoliation be controlled.

The present invention addresses this issue by preventing or substantially reducing the formation of magnetite on the inner bore of superheater and/or reheater pipes through the in situ deposition and formation of a protective layer of oxidation resistant metal. In a first aspect the invention resides in a method of reducing magnetite formation on the bore surface of a pipe including the steps of:

(a) selecting a pipe with a pre-existing oxide layer on its bore surface; and (b) coating the pre-existing oxide layer with an oxidation resistant metal, to thereby reduce magnetite formation on the bore surface of the pipe.

The pipe may be a superheater and/or reheater pipe.

Suitably, the pre-existing oxide layer is a spinel oxide layer.

Preferably, the pre-existing oxide layer is not magnetite. It is possible to electroless plate magnetite and so if traces of magnetite are left attached to the spinel oxide layer after cleaning then this is not a problem, the inventive process will still coat the bore of the pipe and provide protection therefore. The pipes, however, cannot be coated without chemical cleaning as it is too burdensome to attempt to define the thickness of the existing magnetite layer throughout all of the piping. Any areas which had too thick a magnetite layer would be prone to exfoliation even after coating with the oxidation resistant metal. For this reason, and due to the strong adherence observed between oxidation resistant metal coatings and Fe—Cr spinel oxides, it is preferable to remove as much of the existing magnetite as possible prior to coating.

More preferably, the spinel oxide layer is an Fe—Cr (i.e. comprises iron and chromium) spinel oxide layer.

The Fe—Cr spinel oxide layer comprises $FeCr_2O_4$ and/or $Fe_2CrO_4$.

In one embodiment, the Fe—Cr spinel oxide layer consists essentially of $FeCr_2O_4$ and/or $Fe_2CrO_4$.

The oxidation resistant metal which will form the protective layer to reduce magnetite formation will comprise one or more of a relatively wide range of oxidation and/or corrosion resistant metals which are preferably durable and, therefore, long lasting. Some non-limiting examples of such metals are nickel, palladium, platinum, ruthenium, gold, cobalt, rhodium, zinc, cadmium, lead and alloys/mixtures of these. The particular metal chosen will depend on factors such as ease of plating, cost, durability and effect on the pipe metal. In this respect nickel, palladium, cobalt and alloys/mixtures thereof are particularly favourable as they are capable of deposition by well known commercially available processes such as, for example, electroless plating techniques. Nickel is a preferred oxidation resistant metal as it is already present, to an extent, in the pipe alloy metal and so there is little or no risk of negative impact due to diffusion into the parent pipe metal. Nickel can also be electroless plated and is not excessively expensive.

However, nickel will not satisfactorily electroless plate to clean stainless steel and so when nickel and other metals sharing this property are employed as the coating layer it is essential that an existing oxide layer, such as for example an Fe—Cr spinel oxide, be present on the inner bore surface of the pipe for the oxidation resistant metal coating to adhere to. If a metal is employed which can plate directly onto the parent pipe metal then the existing oxide layer may not be necessary.

The thickness of the oxidation resistant metal layer deposited will be in the range of about 5 μm to about 200 μm in thickness. Preferably, the layer of oxidation resistant metal is between about 10 μm to 100 μm in thickness, more preferably within the range of 40μm to 60 μm and even more preferably about 50 μm thick.

The method of the present invention is particularly applicable to treating the inner bore of existing boiler superheater and/or reheater pipes in situ to result in a protective metal coating being deposited directly onto an existing Fe—Cr spinel oxide layer which has been prepared by chemical cleaning to provide an optimum bonding stratum. The deposited oxidation resistant metal layer is able to adhere to the inner surface of the pipe by the growth of interlocking crystal structures, on a scale ranging from the atomic to the micrometre, which are keyed mechanically to the surface irregularities and grains of the pre-existing Fe—Cr spinel oxide layer of the superheater and/or reheater pipe.

This coating layer will substantially reduce or prevent the formation of exfoliable magnetite layers through the prevention of contact of the steam with the underlying austenitic and/or ferritic parent metal during normal operation. The effect of the coating is therefore to reduce and control the build up of magnetite such that exfoliable flakes either do not form or at least, should some flakes exfoliate, do not collect in sufficient quantity to cause blockages in the lower bends of superheater and/or reheater pendant pipes in comparison to the usual time scale of magnetite formation and exfoliation in untreated pipes.

Although not wishing to be bound by any particular theory, it is believed that when the boiler is returned to service, after the superheater and/or reheater pipes have been treated with the method of the present invention, and the tubes and pipes are heated to approaching 600° C. for extended operating hours, some of the plated oxidation resistant metal ions (for example Ni, Pd or Co ions) will diffuse through into the underlying Fe—Cr spinel oxide layer and at least partially modify its composition to form additional compounds such as Ni—Cr, Pd—Cr, Co—Cr and perhaps (Co, Ni ,Pd)—Fe—Cr oxides in various compositions. One or more of these newly formed compounds, particularly Ni—Cr compounds, will likely be extremely tough and oxidation resistant, and are likely to contribute significantly to the protective result achieved by the inventive process described.

Hitherto it has not been possible to coat in situ piping with oxidation resistant metals. The inventor has surprisingly found that a pre-existing oxide layer, for example an Fe—Cr spinel oxide or the like, provides a particularly suitable surface to which the oxidation resistant metal coating can bond. This allows a boiler already in commercial use to be treated so as to substantially reduce the formation of exfoliable magnetite in superheater and/or reheater piping thus presenting savings by reducing the need for regular cleaning and operational downtime.

In a further embodiment the invention resides in a method of reducing magnetite formation in the bore of an iron-containing pipe including the steps of:

(a) selecting an iron-containing pipe with a pre-existing Fe—Cr oxide layer on its inner bore surface;
(b) selecting an oxidation resistant metal from the group consisting of nickel, palladium, cobalt and alloys thereof; and
(c) coating the pre-existing Fe—Cr oxide layer with the oxidation resistant metal, to thereby reduce magnetite formation in the bore of the pipe.

Preferably, the pre-existing Fe—Cr oxide layer is an Fe—Cr spinel oxide layer.

The inner bore of the superheater and/or reheater pipes are preferably first prepared for coating with the oxidation resistant metal by chemical cleaning to remove existing magnetite. This may be achieved by a number of known processes such as the circulation of commercially available mixtures of acids and buffer chemicals specifically selected to result in a clean and amorphous exposed surface of Fe—Cr spinel oxide without exposing the underlying parent metal to any great extent.

In one general embodiment of the first aspect the invention resides in a method of reducing magnetite formation in the bore of a superheater and/or reheater pipe including the steps of:

(a) treating the bore of the pipe to remove existing magnetite and expose an Fe—Cr oxide layer; and
(b) electroless plating a layer of an oxidation resistant metal onto the Fe—Cr oxide layer, to thereby reduce magnetite formation in the bore of the pipe.

Preferably, the oxidation resistant metal is nickel, palladium or an alloy/mixture of the two.

Suitably, the Fe—Cr oxide layer is an Fe—Cr spinel oxide layer.

In one particular embodiment of the first aspect the invention resides in a method of reducing magnetite formation in the bore of an iron-containing pipe including the steps of:

(a) selecting an iron-containing pipe comprising magnetite on its inner bore surface, the magnetite formed on an underlying pre-existing Fe—Cr spinel oxide layer;
(b) treating the inner bore of the iron-containing pipe with a cleaning solution to remove the magnetite and expose the pre-existing Fe—Cr spinel oxide layer;
(c) selecting an oxidation resistant metal from the group consisting of nickel, palladium, cobalt and alloys thereof; and
(d) coating the pre-existing Fe—Cr spinel oxide layer with a layer of the oxidation resistant metal, to thereby reduce magnetite formation in the bore of the pipe.

This method enables the treatment of existing superheater and/or reheater pipes, to reduce future magnetite exfoliation, in situ thereby avoiding the need for more frequent reactive treatments or for the complete replacement of the pipes and other infrastructure with newer alloys which resist magnetite formation.

The Fe—Cr spinel oxide layer is a ceramic like layer which, when activated by an appropriate chemical cleaning process, provides a surface which is active to enable initiation of auto-catalysis of the electroless plating solutions and provides a good bonding surface for the nickel or other electroless plating metal to bond on to. Accordingly, the proper and selective cleaning to expose and activate the spinel layer is important in the present process. The spinel crystals key deeply down into the grains of the underlying pipe parent metal thereby providing a mechanical keying in addition to chemical/metallurgical attachment.

In a second aspect the invention resides in an apparatus for reducing magnetite formation in the bore of a pipe comprising:

(a) a cleaning solution to substantially remove existing magnetite from the bore of the pipe and expose an underlying Fe—Cr spinel oxide layer;
(d) a coating solution to coat the Fe—Cr spinel oxide layer with a layer of oxidation resistant metal; and a system for the delivery, circulation and removal of the cleaning solution and coating solution.

Preferably, the coating solution is an electroless plating solution.

The apparatus of the second aspect may further include one or more of a temporary pipe work system, tanks, pumps and valves to effect the chemical cleaning of the bore of the superheater and/or reheater pipes of exfoliable and exfoliated magnetite and fixed magnetite to result in an amorphous exposed surface of the preferred Fe—Cr spinel oxide being presented to the inner bore. These components further accommodate the delivery of cleaning and coating solutions into the pipe. The coating solutions may represent any convenient means of achieving a coating of the oxidation resistant metal without the need for substantial dismantling of the boiler structure.

On installation of the temporary pipe work system, a cycle of filling, circulating and flushing of commercially available chemical cleaning solutions is utilised to dissolve and convey, in solution, the exfoliable, exfoliated and adherent magnetite from the pipes. The exact formulation of commercially available chemicals will be determined by contractors and suppliers with expertise in such treatments after due consideration of the pipe materials involved, volumes of materials to be dissolved and available handling, neutralisation and disposal options available for the particular boiler being treated.

The chemical cleaning phase is complete when it is determined that substantially all of the magnetite has been removed to achieve a clean and amorphous exposed surface of a suitable oxide, such as an Fe—Cr spinel oxide layer, to form the stratum for coating of the protective oxidation resistant metal layer in the second phase of the treatment process. Having achieved the desired state of cleanliness in the pipe bores the chemical cleaning solutions are flushed from the boiler and replaced with demineralised water (with or without added inhibitors) in preparation for the coating phase.

One particularly suitable process to achieve the coating of the oxidation resistant metal is the delivery of electroless plating working solutions into the pipe bore. The coating of the oxidation resistant metal onto the exposed oxide layer, when performed by electroless plating, is achieved by filling, circulating and flushing at least once, but preferably several times, a working solution of commercially available electroless plating chemicals, in liquid form, through the superheater and/or reheater pipes in periodic forward and reverse circulation directions to achieve an even plating thickness of, for example, nickel or palladium and/or mixtures or alloys thereof. The exact formulation of electroless plating chemicals is determined by those skilled in this area of technology after due consideration of the pipe materials involved, volumes of solutions to be handled and desired final thickness and composition of the protective oxidation resistant metal layer. Having achieved the desired thickness of metal plating the plating working fluids are flushed from the boiler and replaced with demineralised water (with or without added inhibitors) in preparation for a return to service of the boiler.

On completion of the cleaning, flushing and plating treatment the temporary pipe work can be drained and dismantled and all temporary blinds, plugs and blankings which may have been required are removed and the connection points reinstated to restore the pressure integrity of the boiler.

Lagging and cladding is reapplied, scaffolding dismantled and removed and after any additional statutory or regulatory tests the boiler can be returned to normal operation.

Figure 3A:
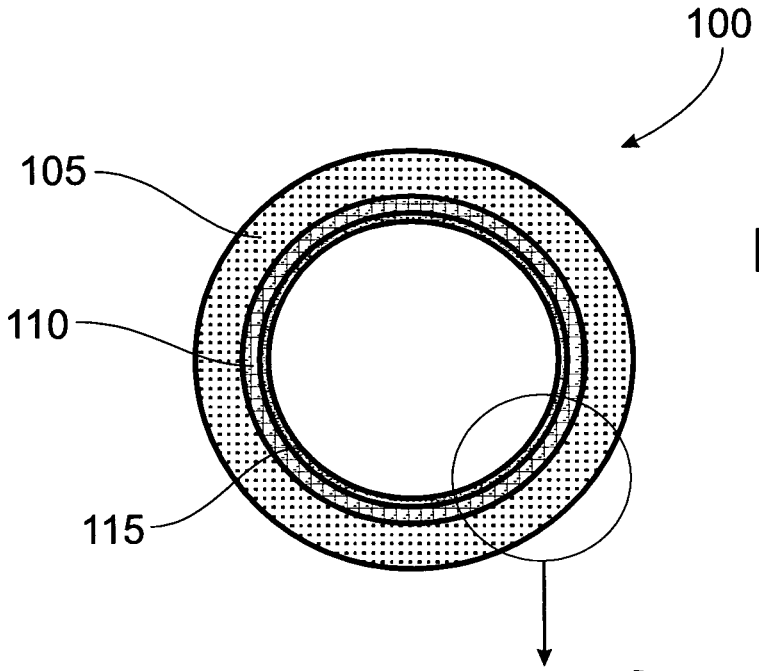
FIG. 3A is a sectional representation of a superheater or reheater pipe after plating treatment according to one embodiment of the present invention.
Figure 3B:
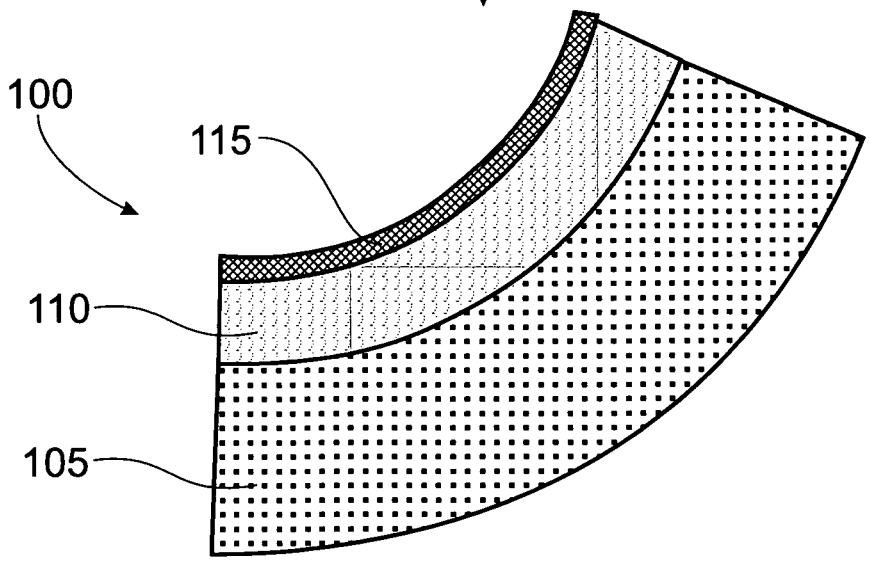
FIG. 3B is an enlarged view of the circled area shown in FIG. 3A.

FIG. 3A is a sectional representation of a superheater or reheater pipe 100 after coating with an oxidation resistant metal as described above. FIG. 3B is an enlarged view of the circled area shown in FIG. 3A. It can be seen that the layer of Fe—Cr spinel oxide 110 remains attached directly to the inner surface of pipe 105 and the layer of oxidation resistant metal 115, in this example nickel and/or palladium, has been coated onto the exposed bore surface of the Fe—Cr spinel oxide layer 110. This protective metal coating acts to substantially reduce the formation, build up and hence exfoliation, of magnetite in the bore of pipe 105.

EXAMPLE

One particular series of actions will now be described to enable the present invention to be put into effect. It should be understood that other means of performing the treatment process are possible and would be clear to a skilled addressee in light of the present disclosure.

The existing boiler to be treated must be taken out of service, cooled down, scaffolding access erected, if required, and insulation and cladding materials removed to provide safe man access to the inlet and outlet headers and pipe work of the superheater and/or reheater. The area on the boiler which houses such headers at the top of the boiler is often referred to as the vestibule or header space 23 and is shown in FIG. 2 as containing the superheater and/or reheater inlet headers 24 and outlet headers 25.

Figure 4:
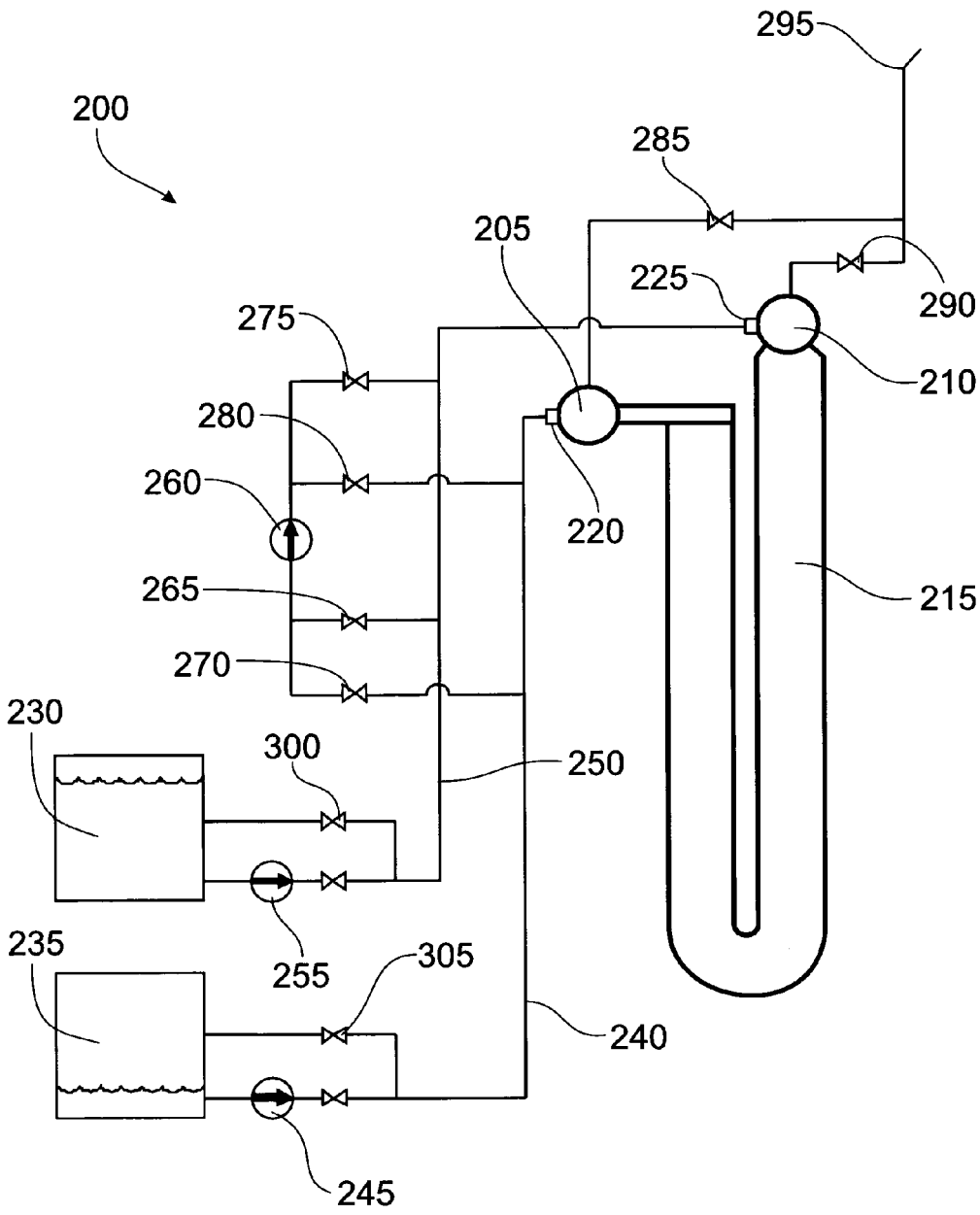
FIG. 4 is a diagrammatic representation of one embodiment of a system which can be used to implement the present invention.

Once man access to the superheater and/or reheater headers, 24 and 25, has been achieved then the temporary pipe work system (or equivalent arrangement) as described in FIG. 4 is installed. FIG. 4 is a diagrammatic representation of one embodiment of a system 200 which can be used to implement the present invention.

Particular attention must be given to the locations selected for connecting the temporary pipe work to inlet and outlet headers, 205 and 210 respectively, such that the headers 205 and 210 can be fully flooded and even flow distribution to pipes 215 achieved. Typical connection points which may be considered favorable would include header interconnector branching pipe work, header inspection nipples and/or header inlet or outlet pipe work.

The particular connection points 220 and 225 which are employed will vary from boiler to boiler and can be best determined by engineers experienced in boiler pressure parts. Further temporary measures to prevent overflowing of liquids to other parts of the boiler may also be necessary through the cutting and blanking of connecting pipe work, or the temporary installation of blinds, dams, or blanking plugs. Additionally, attention must be paid to the collection and safe venting of reaction gases produced during plating, including hydrogen, so as to prevent excessive pressurization of pipe work or development of potentially explosive atmospheres.

The particular details for connection of the temporary pipe work system and venting of gases will be specific to the boiler being treated and cannot be fully described for all such boilers. A skilled addressee familiar with the relevant codes and standards would be able to provide the engineering designs for the connections and the temporary pipe work without difficulty. The connections, once determined, would include at least one but preferably multiple connections 220 to the superheater and/or reheater inlet header 205 and at least one but preferably multiple connections 225 to the superheater and/or reheater outlet header 210.

Having determined through good engineering practice the particular connections, 220 and 225, to be used, and other temporary arrangements including vents and blanking provisions on the superheater and/or reheater inlet and outlet headers, 205 and 210, then the pipe work system, including at least the pipes, pumps, valves and tanks, as described in FIG. 4 or the equivalent thereof, can be installed. The temporary pipe work system comprises the following components and others may be determined necessary on a case by case basis.

Tanks 230 and 235 contain the cleaning, plating and flushing solutions and may receive spent fluids displaced from the superheater and/or reheater 215 being treated. The volumes of each tank, 230 or 235, will at least exceed the volume of the superheater and/or reheater 215 being treated plus the volume of the temporary pipe work.

A pipe work manifold or manifolds 240 is connected to the superheater and/or reheater inlet header 205 at connection 220 and also connects to tank 235 and a pump 245 for the conveying of cleaning, flushing and plating solutions into and/or out of inlet header 205 for the purpose of filling, circulating fluids through and draining the superheater and/or reheater 215.

A pipe work manifold or manifolds 250 is connected to superheater and/or reheater outlet header 210 at connection 225 which connects to tank 230 and a pump 255 for the conveying of cleaning, flushing and plating working solutions into outlet header 210 for the purpose of filling, circulating fluids through and draining superheater and/or reheater 215.

A circulating pump 260 is used with suction side connections to both manifolds 240 and 250 through valves 265 and 270 and discharge side connections to both manifolds 240 and 250 through valves 275 and 280 to provide forward or reverse circulation through the superheater and/or reheater by configuring the closed settings for valves 275, 280, 265 and 270.

A gas venting pipe work system is also employed and is connected to the inlet header 205 and outlet header 210 through gas vent valves 285 and 290, respectively, to a safe area vent 295 for the safe atmospheric release of potentially flammable reaction gases.

Further provisions may also be required, which will be specific to the location and nature of the particular boiler, for filling and draining the tanks, monitoring working levels, sampling solutions and generally performing the operations in a safe and efficient manner.

On completion of the installation of the temporary pipe work systems chemical cleaning of the superheater and/or reheater 215 can commence. It is common in the industry to arrange for the services of a professional contractor to perform chemical cleaning to remove built up magnetite, such contractors having been in service to the power boiler industry for many years and having skilled and experienced professional personnel with knowledge of the appropriate chemical cleaning solutions and solvents required.

It is good practice to remove a tube length from the superheater and/or reheater in advance for representative laboratory testing to determine that the cleaning regime and proper solvent chemical and concentrations for that solvent are verified. Many chemicals including acids and alkalis with inhibitors and buffers have been successfully used for chemical cleaning of boilers and are well known in the art.

There are currently at least two generally recommended chemical cleaning solvent mixtures for the chemical cleaning of superheaters and/or reheaters. The first is a combination of hydroxyacetic and formic acids which may also comprise ammonium bifluoride. The second is an EDTA (ethylenediaminetetraacetic acid) based solution. Other chemical cleaning solutions may also be available or preferred in the circumstances of the particular boiler being treated and available facilities for safely and satisfactorily disposing of the boiler chemical cleaning wastes.

Utilising the pipe work arrangement shown in FIG. 4, chemical cleaning of the superheater and/or reheater 215 may proceed as follows with adjustment as appropriate for the particular boiler being treated and temporary pipe work arrangement as finally configured.

Initial and subsequent fillings of chemical cleaning solvents would be prepared in either of tanks 230 or 235 and pumped through pumps 255 or 245 to achieve complete filling of the superheater and/or reheater 215. Circulation is established through operating pump 260 with forward circulation achieved by maintaining valves 280 and 265 open with valves 275 and 270 shut. Reverse circulation can be achieved by maintaining valves 275 and 270 open with valves 280 and 265 shut. Importantly, gas vent valves 285 and 290 would be maintained open to allow any gases produced to vent safely.

In certain instances a once through cleaning may be sufficient in which case the chemical cleaning solvent may be pumped through at a pre-determined rate in a single pass from either tank 230 or 235 through pump 255 or 245 through the superheater and/or reheater 215 directly returning to the opposite tank through either valve 300 or 305, as appropriate. This is, therefore, achieved without utilising the circulation pump 260 and by maintaining valves 275, 280, 265 and 270 closed or simply excluding them from the installation. After circulation for an appropriate time period in forward, reverse, or periodic alternating forward and reverse directions or once through cleaning the cleaning chemicals can be displaced by flushing the circuits with demineralised water(with or without added inhibitors).

Flushing of the chemical cleaning solvents and solutions from the superheater and/or reheater is achieved by filling either of tanks 230 or 235 with demineralised water (with or without added inhibitors), pumping the water via pumps 255 or 245 to achieve complete filling of the superheater and/or reheater 215 and hence displacing the cleaning chemicals in a once through circulation process (i.e. without utilising pump 260 and generally maintaining valves 275, 280, 265 and 270 in a closed orientation) before directly returning to the opposite tank through either valve 300 or 305, as appropriate. In between successive fillings and flushings new batches of fluids are prepared in either of tanks 230 and 235 with the displaced fluids captured in the opposite tank for neutralization and controlled disposal. Once the cleaning step is complete the inner surface of the superheater and/or reheater pipe will present a suitable spinel oxide layer and is ready for coating with the oxidation resistant metal.

Electroless plating is a mature industrial technology although it has not previously been utilised in the power industry or applied on any real scale to boiler superheaters and/or reheaters. Suitable electroless plating solutions are available commercially and direction and expertise is readily available for the practical application of this technique.

In the manner of the preparatory step mentioned above regarding chemical cleaning, it is also good practice to remove a pipe length from the superheater and/or reheater 215 in advance for representative laboratory testing to verify that, after the cleaning regime, the proposed chemicals for the application of the electroless plating are effective and to determine appropriate concentrations and timing for the plating process. Electroless plating of the cleaned superheater and/or reheater 215 piping can be performed utilising the pipe work arrangement shown in FIG. 4 as follows with adjustment as appropriate for the particular boiler being treated and temporary pipe work arrangement finally configured.

Initial and subsequent fillings of electroless plating solutions are prepared in either of tanks 230 or 235 and pumped through pumps 255 or 245 to achieve complete filling of the superheater and/or reheater 215. Circulation is established through operating pump 260 with forward circulation achieved by maintaining valves 280 and 265 open with valves 275 and 270 shut. Reverse circulation can be achieved by maintaining valves 275 and 270 open with valves 280 and 265 shut.

Importantly, gas vent valves 285 and 290 must be maintained open to allow hydrogen and any other gases produced to vent safely without causing pressurization of the temporary pipe work or allowing a potentially explosive atmosphere to develop. In certain instances a once through electroless plating application may be required in which case the electroless plating solution is pumped through at a pre-determined rate in a single pass from either tank 230 or 235 through pump 245 or 255, through the superheater and/or reheater 215 before directly returning to the opposite tank, 230 or 235, through either valve 300 or 305 as appropriate, in which case, electroless plating of the superheater and/or reheater is achieved without utilising circulation pump 260, and valves 275, 280, 265 and 270 are maintained closed or simply excluded from the installation.

Timing of the electroless plating process and flow rate are important to achieving an even plating thickness. Accordingly, pump delivery rates and flow balancing through the superheater and/or reheater 215 is imperative to achieving a good plating result. It is preferable to achieve the electroless plating process slowly and in incremental lesser thicknesses to achieve an overall even thickness throughout the superheater and/or reheater 215.

After circulation for an appropriate period in forward, reverse, or periodic alternating forward and reverse directions, or a once through pass, the electroless plating solution is displaced by flushing the circuits with demineralised water (with or without added inhibitors). In between successive fillings and flushings new batches of electroless plating solutions or demineralised water are prepared in either of tanks 230 and 235 with the displaced fluids captured in the opposite tank, 230 or 235, for neutralization and controlled disposal.

Flushing of the electroless plating solutions from the superheater and/or reheater 215 is achieved with filling of either of tanks 230 or 235 with demineralised water (with or without added inhibitors), pumping it through pumps 255 or 245 to achieve complete filling of superheater and/or reheater 215 and displacing the electroless plating solutions in once through circulation (i.e. without utilising pump 260 and generally maintaining valves 275, 280, 265 and 270 in a closed orientation) through superheater and/or reheater 215 and directly returning to the opposite tank through either valve 300 or 305 as appropriate.

Disposal of used boiler cleaning chemicals, flushing fluids and electroless plating solutions should be prepared for in advance with suitable holding containments of sufficient volumes to cater for the full complement of fluids. Disposal is usually performed in conjunction with a licensed waste disposal contractor with typical methods involving some or all of the following: evaporation; incineration; co-ponding, recycling for metals and/or secured landfill.

Accordingly, it should be apparent that the present invention provides for the generation of an inner pipe surface coated with a layer of an oxidation resistant metal which helps reduce magnetite build up and hence exfoliation. The protective oxidation resistant metal layer may comprise, for example, nickel or palladium or alloys thereof, and may be achieved by electroless plating. The present method allows these benefits to be applied to existing boiler plants which have already exhibited a tendency for the occurrence of tube blockages caused by magnetite exfoliation, and for which the aforementioned prior art preventative methods could not be economically applied.

The procedures described also employ, in part, 'reactive' solutions to remove and carry exfoliable or exfoliated magnetite out of the boiler in solution, as described, thus leaving the superheaters and /or reheaters clean and serviceable but with the hitherto unknown advantages of subsequently treating the inner bore of the existing tubes such that the growth and development of exfoliable magnetite is substantially reduced thereby resulting in a much extended period of reliable operation than that which can be achieved by prior art reactive solutions alone.

The benefits of the present invention can be implemented in a single application or, at most, infrequent periodic treatment of in situ superheater and/or reheater tubes. It should be appreciated that no prior art solution can achieve the same results for existing boilers with a single or infrequent periodic treatment with the potential of saving facility owners enormous costs in repairs and avoided lost production due to tube failures with the root cause attributable to magnetite exfoliation.

The method of the present invention helps to reduce and control the severity and frequency of magnetite exfoliation such that, to the extent that magnetite exfoliation does occur, no tube blockages of pendants occur as a result of boiler normal operation and cool down cycles. Since magnetite layer thickness and/or growth rate is greatly reduced, any stress resulting from different coefficients of thermal expansion between the underlying spinel oxide layer and any small amount of magnetite which may form is insufficient for initiation of delamination of the magnetite and spinel oxide layers and, hence, exfoliation of the magnetite does not occur. The method described will thus permit a much extended period of normal operation between required maintenance downtime in the superheaters and reheaters as a consequence of reduced magnetite exfoliation.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. A method of substantially preventing magnetite formation in the bore of a pipe including the steps of:

(a) selecting a pipe with a pre-existing oxide layer on its inner bore surface; and (b) coating the pre-existing oxide layer with an oxidation resistant metal, to thereby substantially prevent formation of exfoliable magnetite layers in the bore of the pipe.

2. The method of claim 1 wherein the pipe is manufactured from an austenitic and/or ferritic alloy.

3. The method of claim 1 or claim 2 wherein the pipe is a superheater and/or reheater pipe.

4. The method of claim 3 wherein the coating of the superheater and/or reheater pipe is carried out in situ.

5. The method of claim 3 wherein the superheater and/or reheater pipe has been in use for a sufficient period of time to develop a spinel oxide layer on its inner bore surface.

6. The method of claim 5 wherein the spinel oxide layer comprises iron and chromium.

7. The method of claim 1 wherein the pre-existing oxide layer is a spinel oxide layer.

8. The method of claim 7 wherein the spinel oxide layer is an Fe—Cr spinel oxide layer.

9. The method of claim 8 wherein the Fe—Cr spinel oxide layer comprises $FeCr_2O_4$ and/or $Fe_2CrO_4$.

10. The method of claim 1 wherein the oxidation resistant metal is oxidation and corrosion resistant at elevated temperatures.

11. The method of claim 1 wherein the oxidation resistant metal is selected from the group consisting of nickel, palladium, cobalt, platinum, ruthenium, gold, rhodium, zinc, cadmium and lead.

12. The method of claim 11 wherein the oxidation resistant metal is nickel, palladium, cobalt or an alloy thereof.

13. The method of claim 12 wherein the oxidation resistant metal is nickel or a nickel alloy.

14. The method of claim 1 wherein the coating with the oxidation resistant metal is carried out using a solution of the oxidation resistant metal.

15. The method of claim 1 wherein the coating with the oxidation resistant metal is carried out by electroless plating.

16. The method of claim 1 wherein the thickness of the oxidation resistant metal coating is between 5 micrometers to 200 micrometers.

17. The method of claim 16 wherein the coating is between 10 micrometers to 100 micrometers thick.

18. The method of claim 17 wherein the coating is between 40 micrometers to 60 micrometers thick.

19. The method of claim 18 wherein the coating is about 50 micrometers thick.

20. The method of claim 1 further comprising the step of treating the bore of the pipe to remove existing magnetite and expose an underlying spinel oxide layer substantially formed from a compound comprising iron and chromium.

21. The method of claim 20 wherein the treatment step is carried out using an EDTA solution and/or a combination of hydroxyacetic and formic acids.

* * * * *